US008142281B2

(12) United States Patent
Robins et al.

(10) Patent No.: US 8,142,281 B2
(45) Date of Patent: Mar. 27, 2012

(54) GAMING APPARATUS

(76) Inventors: Stephen Robins, Leeds (GB); Robert Hepworth, Leeds (GB)

( * ) Notice: Subject to any disclaimer, the term of this patent is extended or adjusted under 35 U.S.C. 154(b) by 807 days.

(21) Appl. No.: 12/067,668

(22) PCT Filed: Sep. 22, 2006

(86) PCT No.: PCT/GB2006/003545

§ 371 (c)(1),
(2), (4) Date: Aug. 11, 2008

(87) PCT Pub. No.: WO2007/034212

PCT Pub. Date: Mar. 29, 2007

(65) Prior Publication Data

US 2008/0305858 A1 Dec. 11, 2008

(30) Foreign Application Priority Data

Sep. 24, 2005 (GB) ..... 0519532.6

(51) Int. Cl.
*A63F 9/24* (2006.01)

(52) U.S. Cl. ..... 463/25

(58) Field of Classification Search ..... 463/25
See application file for complete search history.

(56) References Cited

U.S. PATENT DOCUMENTS

| | | | | |
|---|---|---|---|---|
| 6,270,410 | B1 | 8/2001 | Demar et al. | |
| 2002/0198044 | A1 | 12/2002 | Walker et al. | |
| 2004/0162124 | A1 | 8/2004 | Barton | |
| 2004/0192442 | A1 | 9/2004 | Wells et al. | |
| 2005/0181868 | A1 * | 8/2005 | Vlazny et al. | 463/28 |
| 2005/0233794 | A1 * | 10/2005 | Cannon et al. | 463/16 |

FOREIGN PATENT DOCUMENTS

| | | |
|---|---|---|
| WO | WO 01/03786 | 1/2001 |
| WO | WO 02/101486 | 12/2002 |
| WO | WO 03/027970 | 4/2003 |
| WO | WO 03/107287 | 12/2003 |

* cited by examiner

*Primary Examiner* — Pierre E Elisca
(74) *Attorney, Agent, or Firm* — Grady K. Bergen; Griggs Bergen LLP

(57) ABSTRACT

The invention relates to a device which can be used in a gaming environment, typically to allow the user to place bets on specific games which are represented on the display screen of the device. The device is wireless which allows the user to be free to move around an area rather than be confined to a specific location to play the game. The device connects with a server via which bets can be placed and results notified to the device. The results data can be generated from a selected source such as a live game result or data generated by the server.

10 Claims, 4 Drawing Sheets

GAMING APPARATUS

This application claims priority under 35 U.S.C. §371 on International Application No. PCT/GB2006/003545, with an international filing date of Sep. 22, 2006, which claims priority on British Application No. 0519532.6, filed Sep. 24, 2005, each of which is incorporated herein by reference in its entirety.

The invention to which this application relates is apparatus which can be used for the purpose of gaming and, in particular to provide apparatus in a form which can in one embodiment be selectively linked with the sort of gaming activities which occur within casinos without having to be present at the location of the gaming activity.

The provision of gaming activities is well known, and increasing. Gaming activities include roulette, black jack and other card games, dice games and the like. This type of game typically occurs in buildings known as casinos and the development of the same is particularly well known in locations such as Las Vegas. Conventionally participation in these games has required the player to be physically present at the location of the game. This can be problematic in that the user may not always be able to stay at the location as they may want to have a rest break, meals and/or sleep. To the gaming providers these other activities represent time when they are losing money, as the players are not taking part in the games.

Until recently this problem has been tolerated as there have been in place relatively tight guidelines in terms of the locations where gambling may take place, typically within the vicinity of the tables. However, a relaxation of these laws, while still restricting use in certain areas, has meant that there is an opportunity to allow gaming activity to be undertaken by players in a larger area.

The aim of the present invention is to provide apparatus which allows the gaming company to provide to players the opportunity to participate in gaming activities without the players having to be restricted to a location physically adjacent to the gaming activity.

In a first aspect of the invention there is provided apparatus for use by a person to participate in a gaming activity within a defined area, said apparatus including a device to allow user interaction with the said activity by placing a bet, display means to display to the person the progression of the gaming activity and data transmitting and receiving means wherein data representative of the placing of the bet is transmitted via a wireless transmission system to a server for processing said data and data representative of a game result is transmitted from the server to the device along and an indication is generated to show whether the person has won or lost their bet with respect to the received data.

Typically the progression of the gaming activity is shown in real time.

Typically the device is provided for use within the environs of a building including a casino but is portable so that the player can carry the device with them to allow the player to participate in a gaming activity of the type played in a casino without having to be physically present at a location of the gaming activity in the casino. Furthermore even though the player is present in the casino they are not restricted to participating only in a game which is occurring on the casino tables at that time, although that is one possibility.

In one embodiment the apparatus includes a touch sensitive display screen for displaying betting data, and/or displaying the progression of the gaming activity and/or a result and allowing the player to input operating commands and/or place bets by interacting with the device via the touch screen feature.

In one embodiment the apparatus includes selection means to allow the player to select to participate in and/or view the progression of a particular gaming activity. In one embodiment the particular game can be selected from a plurality of gaming activities available and once selected, a signal is transmitted from the device to the server to indicate the gaming activity for which data is to be received and therefore allow the player to interact with the selected game. In one embodiment the selected game can be table or a fixed physically present gaming location and the device can be used to remotely interact with said location.

In a preferred embodiment the apparatus includes means to determine the position of the device carried by the player and, dependent upon the detected location of the device within the building, the device can be rendered operable or inoperable, independently of the player's activities. This facility allows the apparatus to be compliant with legislation which may only allow participation in gaming activities in specific locations.

In one embodiment the detection of the location of the device is achieved by including an RF, or MFID tag in or on the device and, at each exit or entrance interface between areas where the gaming activity is allowed and areas where the gaming activity is not allowed, RF or MF ID antenna are provided so as to detect the passage of the device therethrough. Depending on the direction of movement of the device the activation of the tag and detection by the antenna allows the device to be rendered operable or inoperable as required.

In an alternative embodiment the area in which the device may be operated is mapped and represented electronically and as a result of the mapping and typically using a GPS system provided in the device, so the location of the device within the mapped area can be detected at all times. If necessary, when the device is identified as being in an area where play is not authorised, the device can be disabled for use.

In one embodiment of the invention the apparatus includes a means for receiving the result of a gaming activity which is occurring at a table in the building at that time and the result is used as the result data which is transmitted to the device. It should be noted that only the result will typically be used, not data relating to the remainder of the game at the table. Alternatively, an electronic result can be generated by the server and/or a random number generator can be used. In one embodiment the system or the system supervisor may select the origin of the result data.

In one embodiment the transmission means includes a connection from the detection means to a data processor and wireless communication means between the data processor and one or a plurality of said devices.

Typically, said data is transmitted, at least partially, to the said portable devices by wireless transmission means.

In a preferred embodiment the said portable devices are rendered operable or inoperable depending on their detected location at any given time. In one embodiment the devices are provided to be carried around within a building such as a casino or the like and may be operable only within the building or only within specified areas of the building, in accordance with legislation or building management requirements at any given time.

Typically the operation of the devices can be tailored to suit the particular requirements for each building.

In one embodiment, in addition to the transmission of data from the devices to allow the placing of bets, data is also transmitted to and stored in a processor to provide a record of the usage and betting activity performed via said devices.

In one embodiment of the invention each of the devices as herein described utilises the same version of software which controls the operation of the same at any given time.

This ensures, firstly that the devices are all operating in the same predictable manner and secondly the organisation responsible for operation of the devices can be certain that the software version being used by all of the devices has been approved by the licencing or regulatory authority.

In one embodiment of the invention the player of each device can be identified and be part of a reward/loyalty scheme based on the number of "plays" the player is identified as having participated in.

In one embodiment biometric scanning can be used as all or part of a recognition and/or security and/or tracking and/or analysis program used in tandem with a secure or unsecured wireless or fixed network, and in tandem or separately with, gaming and wagering and betting applications is provided as part of the device.

In one embodiment, the biometric scanning system can be utilised separately or in tandem with door entry systems, security systems, customer and staff tracking and/or, health and safety initiatives.

In one embodiment the biometric scanning system can also be used as a log on or log off means for customers, staff, shift changes, rotor changes, dealer changes and/or croupier changes.

In a yet further embodiment the biometric system can be used in tandem or separately as a game analysis tool to analyse games, for example, roulette spins per hour and per session can be logged and an analysis of wins and wheel sections and session data can also be generated.

In one embodiment the biometric system can also be used as a game analysis tool to analyse games such as card games and/or to log hands dealt per hour and per session and analyse wins and player positioning and wins by player.

In one embodiment the biometric system can be used to monitor, verify and/or track games that utilise a number and/or ball.

In another embodiment the scanning system can be used in part or in whole in the running of membership schemes, loyalty and reward schemes, progressive jackpots, electronic bank accounts and ball and number tracking.

In a further aspect of the invention there is provided a method of performing a gaming activity within a defined area, said method comprising the steps of performing one or more gaming activities at one or more locations, generating digital data representative of a result of a gaming activity, said result data transmitted to one or a series of portable devices via which a display representative of a game to which the result relates is generated, wherein said result data is transmitted electronically from a server, said server receiving data from the said device which is representative of any bets placed by the user of the device and calculating the win or loss with respect to the result data and allocating winnings to the user's account accordingly.

BRIEF DESCRIPTION OF THE DRAWINGS

Specific embodiments of the invention are now described with reference to the accompanying drawings, wherein.

DETAILED DESCRIPTION

Figure 2:
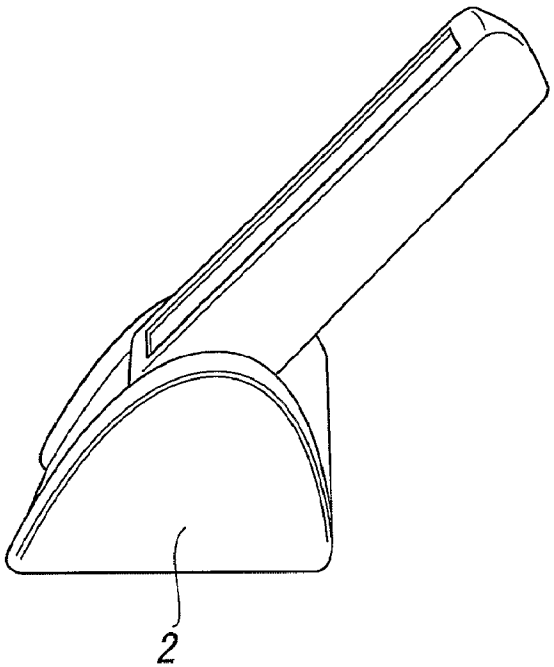
FIGS. 1 and 2 illustrate views of a device in an embodiment in accordance with the invention.
Figure 1:
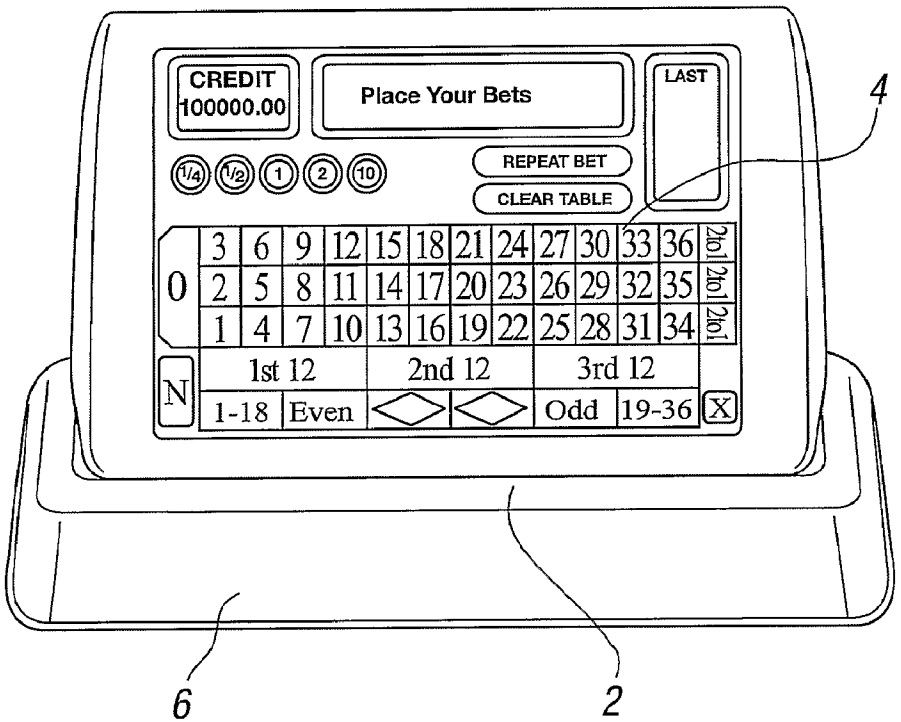
Figure 3:
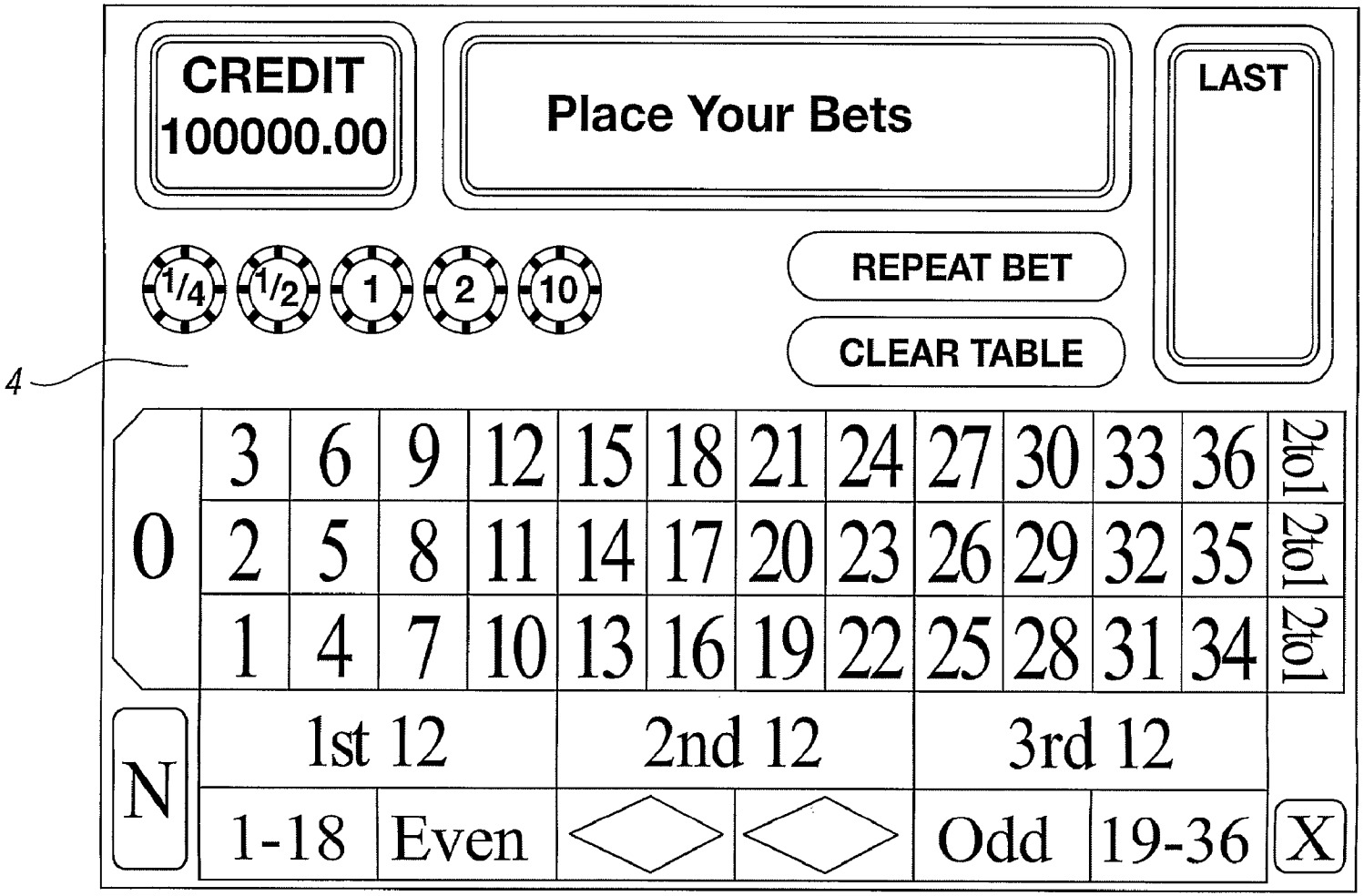
FIG. 3 illustrates a display screen in one embodiment.

Referring firstly to FIGS. 1-3, there is illustrated a device 2 which can be used as a hand held portable device to take part in a gaming activity. In this example, the gaming activity is roulette although it should be appreciated that the use of the device and the apparatus in accordance with the invention is not limited to this particular gaming activity and that typically a number of different gaming activities will be available to the user to select.

The device incorporates a display screen 4 which allows data relating to the progression of a roulette game being displayed to the user such as for example the result in terms of the particular number and/or colour on which the ball lands on the roulette table.

A series of input means which in this case are provided as a touch screen format overlying the display screen 4 are provided which allow the user to select the operation status of the device and also to input their gambling selections or bets. Also provided within the device, although not shown, are a data signal receiver and transmitter which allows the reception and transmission of data via a wireless communication system. This can be of any suitable form for the environment in which the device is used. Processing means are provided to allow the received and transmitted data to be processed accordingly, either in response to user input and/or to cause the display of the appropriate information on the display screen 4 of the device. A holder or stand 6 is provided to allow the device to be positioned in a variable condition when not held.

In accordance with this embodiment of the invention, an RFID identification tag is also incorporated on or within the device and the use for this will be described subsequently.

Thus, in use, the device can be carried by a person taking part in a gaming activity without having to participate in the gaming activity at any particular location in, for example, a building with a casino. Thus, they need not stand next to the roulette table itself to take part in a roulette game and need not take part in that game at all via the device but may choose to receive the randomly generated result data or data from another game. This therefore allows the person to take advantage of other facilities available within the building and still play roulette even though they are not at a roulette table in a building.

As legislation changes, it is becoming possible for gaming activities to take place in areas of a building or environment which were not previously possible. Traditionally, to take part in the gaming activity, the person would have to be present at the table such as the roulette table. However, the legislation has been relaxed to allow gaming activity to take place in other areas which are not directly adjacent to the table and it is because of this that this current device is particularly attractive. However, it is still the case that certain areas of a building or environment are still designated as areas where gaming activity cannot take place and therefore there is a need to control the use of the device so as to ensure that the person cannot take place in a gaming activity in these areas.

Figure 4:
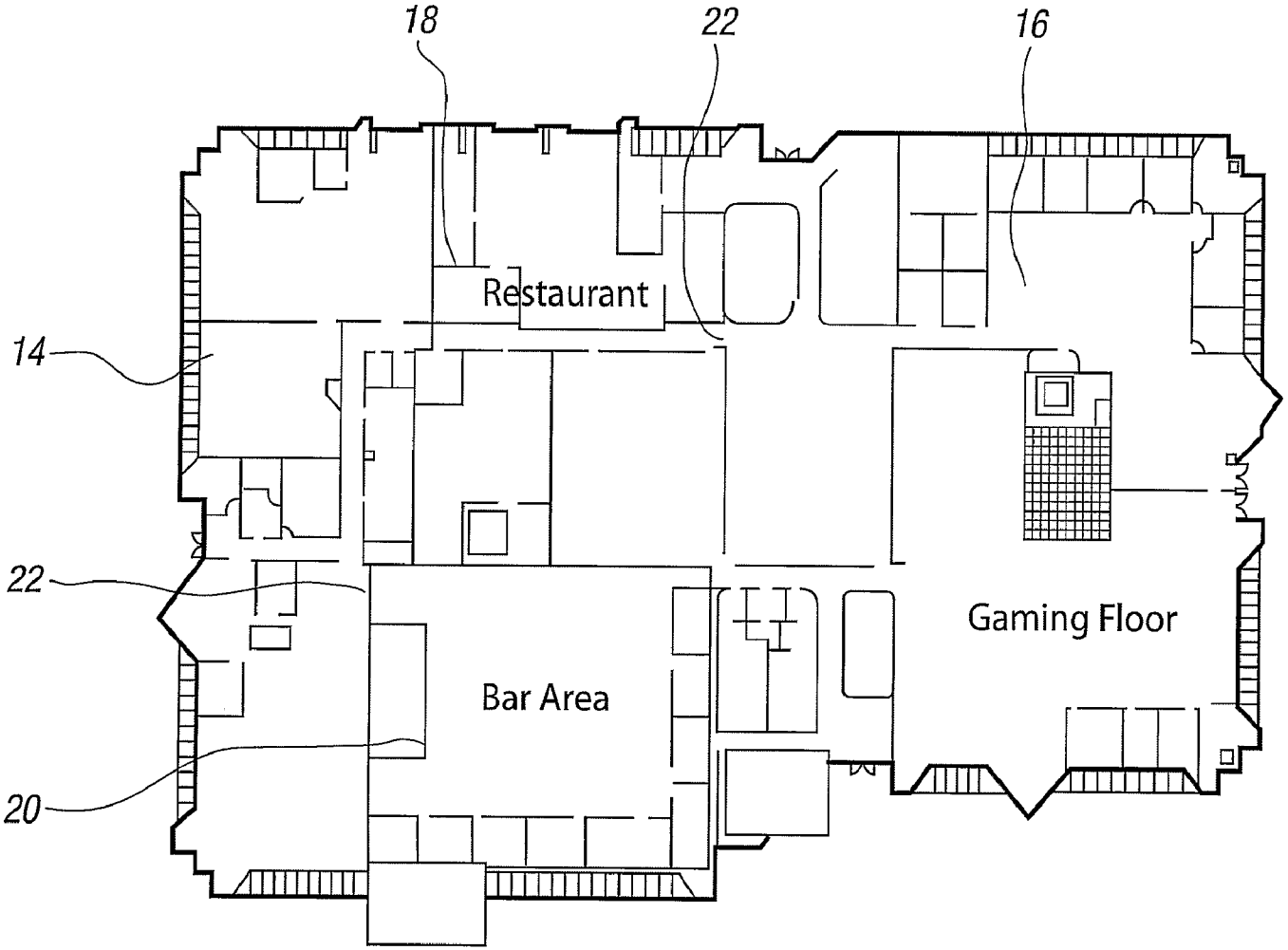
FIG. 4 illustrates a plan view of a building in which the device may be used and in which the apparatus in accordance with one embodiment of the invention is utilised.

FIG. 4 illustrates a plan view of a building 14 which is provided for illustration purposes of the invention. In this building, there is provided a gaming floor 16 in which all the gaming tables are located, a restaurant 18, and licensed bar 20. If, for the purpose of illustration, it is taken that gaming activity is allowed only in the gaming floor 16 and bar 20 but not in the restaurant 18, then the device 2 in accordance with the invention needs to be rendered operable in permitted areas but inoperable in the children's play area and reception area.

In accordance with one embodiment of the invention this is achieved by incorporating an RFID tag on the device as previously described and, at the exit and entrance interfaces 22 between the gaming room, bar and restaurant, RFID antennas are located. The RFID antennas are provided to detect the RFID tags in the devices such that if the player has a device as they move from one of the areas into the restaurant, the detection of the tag means that the tag is activated and causes the device to be rendered inoperable. If and when the player with the device moves in the opposing direction into one of the areas where gaming activity is permissible, then the reverse will occur upon detection of the tag and the activation of the tag will cause the device to become operable. It is envisaged that at these interfaces warning signs will be provided so as to ensure that players who are participating in a gaming activity do not suddenly find that they can no longer take part and have no understanding as to why.

Figure 5:
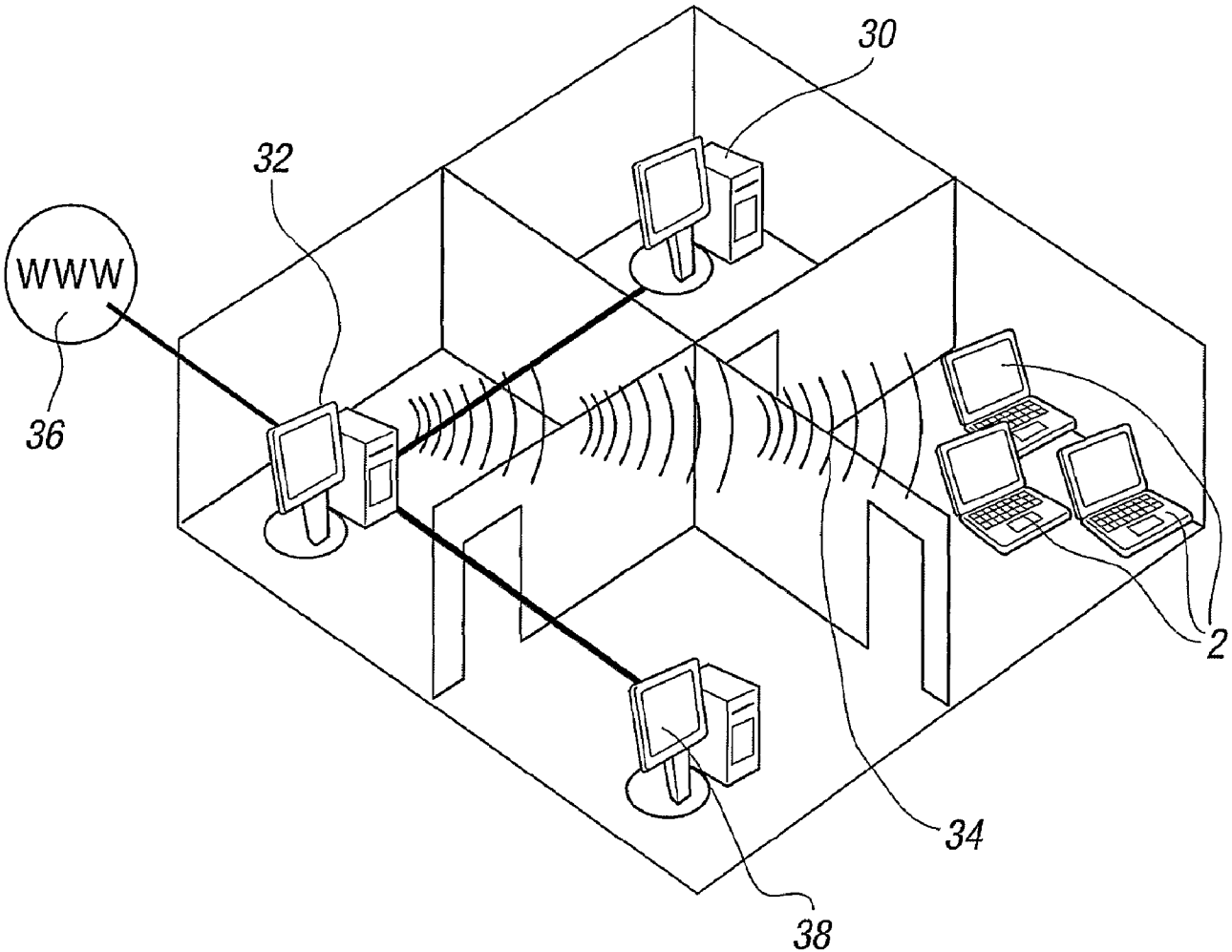
FIG. 5 illustrates a diagram illustrating one embodiment of the system for the transfer of data in accordance with one embodiment of the invention.

FIG. 5 illustrates an example of a system network in accordance with the invention where there is provided a gaming floor and, a "pit" management system 30 which receives data from sensors which indicate the progression of gaming activity. This in turn communicates with a server or central processor 32. The processor 32 can transmit data representative typically, of the results only of a gaming activity programme 34 wirelessly. The data is received by the devices 2 as shown. The data can also be sent to other locations such as the internet 36 and/or cashier systems 38.

In a preferred embodiment of the invention the software which is required to control the operation of the devices is held within each device. Typically the software is downloaded at specified times from a FTP server remotely located, and via a wireless transmission. This is in contrast to conventional systems where the software for the terminal is held locally or on site such as a local server or on the terminal itself.

In the current invention the software is held in the remote FTP site and is downloaded through a local server and on to the device. The advantage of this is that each software version is accessible to the operator and by loading the software this way he can always be sure that all of the devices are running the same version. Furthermore, holding the software remotely allows Gaming bodies/commissions/boards to monitor the software which is being used, so they can be sure that what they have signed off as legal is in fact the program on the devices.

A further advantage is that should a device go faulty or lose power then when it is back up or replaced, the game that the player was in before the problem is not lost and is laid on to the device again. Other systems have a problem when a terminal goes down in as much that the data is lost for that particular terminal.

Thus, the procedure in accordance with one embodiment of the invention is now described for a person taking part in the gaming activity. In this case, roulette is the selected gaming activity with the selection being made by the user of the device. The activity starts by the player being invited to place a bet via the device. In this case, the player decides to place a bet on "23 red" by touching that portion of the screen shown in FIG. 3. A data signal is then transmitted from the device to the central processor or server at which the bet is received and logged. A result is then generated either electronically or by providing a result from a roulette wheel turning at one of the tables. In this case a series of sensors which are provided on the wheel detect on which number the ball has landed and a data signal representing this number is sent to the central processor. The central processor will then generate a wireless data transmission to all the devices indicating the particular number and colour on which the ball has landed and will also calculate whether any of the bets placed via the devices has won and transmit a message to the device indicating the same.

The player of the device can also qualify for other promotions or schemes such as loyalty schemes. In one embodiment this can be calculated on the basis of the number of plays which go through a device and hence the apparatus in accordance with the invention, by each player. Typically each device is assigned to a players number, and a count is also kept of the total number of plays through a device by all users.

On the basis of this a "spot" prize can be awarded to the current player based on his activity and a larger prize can be awarded when a cumulative number of plays have been recorded through a device.

In this way a "progressive jackpot" can be created per device, cumulatively by all of the devices in a particular location, or nationally by linking the plays through the devices from a number of gaming centres using the apparatus.

Thus, there is provided a device on which is created a virtual game. Nothing that is done by the user on the device will have any effect on the result data used. The result is typically the only part of the game play which could be referred to as "live". Alternatively the result can be electronically generated either by a Random number generator or electronic wheel and in other cases the table will be closed and a dealer could simply be spinning the wheel to create a result. By bringing the result from a wheel the user feels that they are playing a "real" game, but it's not necessarily live.

The player plays the game on the device and is not connected in any way to a table and therefore is not playing a remote game, but rather a stand alone game. The parameters of the device may or may not follow the parameters for a physical gaming table, i.e max & min may be different. The user will not interact with the dealer or any other device and can therefore act as though they are playing the table where the result is coming from, and it is in fact the source of the result which is remote.

The provision of the devices as herein described allows improved playing of gaming activities as herein described.

We claim:

1. An apparatus for use by a person to participate in a gaming activity within a defined area, said apparatus including a portable device to allow user interaction with and to play the said gaming activity by placing a bet, a display to display to the person the progression of the gaming activity and data transmitting and receiving means wherein data representative of the placing of the bet is transmitted via a wireless transmission system to a server for processing said data and data representative of a result of the same gaming activity type is transmitted from the server to the device along and an indication is generated to show whether the person has won or lost their bet with respect to the received data, and means are provided to determine the position of the device carried by the user and, dependent upon the detected location of the device, the device can be rendered operable or inoperable, independently of the user's activities, and the device includes selection means to allow the user to select and participate in and/or view the progression of the particular gaming activity and a signal is transmitted from the device to the server to indicate the user selection and particular gaming activity for which data is to be provided and therefore allow the user to interact with the selected game via the device, wherein the particular type of gaming activity performed on the device can be selected by the user from a plurality of available gaming activities which are occurring at that time and the playing of the selected gaming activity by the user on the device has no effect on another game of the same gaming activity type from which the result data is obtained and used to determine whether the user has won or lost the playing of the selected gaming activity on the device.

2. The apparatus according to claim 1 wherein the device includes a touch sensitive display screen for displaying data representative of the progression of the gaming activity and allows the player to input operating commands and/or place bets by interacting with the device.

3. The apparatus according to claim 1 wherein the detection of the location of the device is achieved by including an RF or MFID tag in or on the device and, at each exit or entrance interface between areas where the gaming activity is allowed and areas where the gaming activity is not allowed, RF or MFID antenna are provided so as to detect the passage of the device therethrough.

4. The apparatus according to claim 1 wherein the area in which the device is operated is mapped and represented electronically with respect to the detected location of the device to allow the device to be rendered operable or inoperable depending on the identified location.

5. The apparatus according to claim 1 wherein the apparatus includes a gaming activity table at which a gaming activity takes place and means for receiving an indication of the result of the gaming activity and transmitting the result data to one or more portable devices.

6. The apparatus according to claim 1 wherein the devices are operable only within a building or only within specified areas of a building.

7. The apparatus according to claim 1 wherein in addition to the transmission of data from the device to allow the placing of bets, data is also transmitted to and stored in the server to provide a record of the usage and betting activity performed via said device by the person.

8. The apparatus according to claim 1 wherein a plurality of devices are provided and each of the devices utilises the same version of software which controls the operation of the same at any given time.

9. The apparatus according to claim 1 wherein the device can be used to remotely interact with a gaming table or other physical gaming location.

10. A method of performing a gaming activity within a defined area, said method comprising performing one or more gaming activities at one or more locations, generating digital data representative of a result of the gaming activity, said result data transmitted to one or a series of portable devices via which a display representative of a game to which the result relates is generated, wherein said result data is transmitted electronically from the server, said server receiving data from the said device which is representative of any bets placed by the user of the device and calculating the win or loss with respect to the result data and allocating winnings to the user's account accordingly, determining the position of the device carried by the user and, dependent upon the detected location of the device, rendering the device operable or inoperable, independently of the user's activities, and the device includes selection means to allow the user to select and participate in and/or view the progression of the particular gaming activity and transmitting a signal from the device to the server to indicate the user selection and particular gaming activity for which data is to be provided, said user interacting with the selected game via the device, wherein the particular type of gaming activity performed on the device can be selected by the user from a plurality of available gaming activities occurring at that time and the playing of the selected gaming activity by the user on the device has no effect on another game of the same gaming activity type from which the result data is obtained and used to determine whether the user has won or lost the playing of the selected gaming activity on the device.

* * * * *